US005718510A

United States Patent [19]

Farmery et al.

[11] Patent Number: 5,718,510

[45] Date of Patent: Feb. 17, 1998

[54] PASTE PRODUCTION AND STORAGE APPARATUS

[75] Inventors: Richard A. Farmery, Orillia; Reichel A. Tenbergen, Hanmer; David A. Landriault, Sudbury, all of Canada

[73] Assignees: Inco Limited, Toronto; GL&V Process Equipment Group Inc./GL&V—Groupe Equipement de Procedes Inc., Orillia, both of Canada

[21] Appl. No.: 396,125

[22] Filed: Feb. 28, 1995

[51] Int. Cl.[6] ..... B01F 5/12; B01F 7/24

[52] U.S. Cl. ..... 366/266; 366/295

[58] Field of Search ..... 366/64–67, 96–98, 366/184, 262, 263, 265, 266, 292, 293, 295, 309, 312, 313, 320, 325.1, 342, 343, 329.1–329.3

[56] References Cited

U.S. PATENT DOCUMENTS

| | | | |
|---|---|---|---|
| 690,375 | 12/1901 | Rubsch, Jr. | 366/270 X |
| 1,240,869 | 9/1917 | Noble | 366/194 X |
| 1,738,898 | 12/1929 | Head | 366/182 |
| 2,298,317 | 10/1942 | Smith | 366/313 X |
| 2,367,149 | 1/1945 | Smith | 366/295 X |
| 2,851,257 | 9/1958 | Morgan | 366/195 |
| 3,049,413 | 8/1962 | Sifford . | |
| 3,230,282 | 1/1966 | Van Lookeren Campagne et al. | 366/312 X |
| 3,417,968 | 12/1968 | Schlect . | |
| 3,445,090 | 5/1969 | Lodige et al. | 366/312 X |
| 3,675,904 | 7/1972 | Bremmer et al. | 366/320 |
| 3,685,654 | 8/1972 | MacLellan et al. . | |
| 3,801,286 | 4/1974 | Anolick et al. . | |
| 4,055,494 | 10/1977 | Emmett, Jr. . | |
| 4,095,307 | 6/1978 | Brubaker | 366/312 X |
| 4,185,925 | 1/1980 | Gazzoni | 366/69 |
| 4,225,247 | 9/1980 | Hodson | 366/40 |
| 4,231,664 | 11/1980 | Flock et al. | 366/35 |
| 4,391,529 | 7/1983 | Hedrich et al. | 366/266 |
| 4,515,483 | 5/1985 | Muller et al. | 366/312 X |
| 4,525,072 | 6/1985 | Giusti | 366/313 X |
| 4,552,461 | 11/1985 | Ott et al. | 366/279 |
| 4,830,507 | 5/1989 | Bagatto et al. | 366/132 |
| 4,944,595 | 7/1990 | Hodson | 366/65 |
| 5,080,803 | 1/1992 | Bagatto et al. . | |
| 5,248,485 | 9/1993 | Lilja et al. | 366/37 X |

FOREIGN PATENT DOCUMENTS

| | | | |
|---|---|---|---|
| 7316860 | 8/1973 | Germany . | |
| 54-51974 | 4/1979 | Japan | 366/66 |
| 62-57636 | 3/1987 | Japan | 366/313 |
| 62-186929 | 3/1989 | Japan | 366/307 |
| 4-326935 | 11/1992 | Japan | 366/320 |
| 321042 | 5/1972 | U.S.S.R. | 366/262 |
| 565701 | 7/1977 | U.S.S.R. | 366/320 |
| 731997 | 5/1980 | U.S.S.R. | 366/309 |
| 1148604 | 4/1985 | U.S.S.R. | 366/194 |
| 1368182 | 1/1988 | U.S.S.R. | 366/292 |
| 2183496 | 6/1987 | United Kingdom | 366/313 |

OTHER PUBLICATIONS

Derwent Abstract No. 2573637 of Soviet Pat. No. 731997.

*Primary Examiner*—Charles E. Cooley
*Attorney, Agent, or Firm*—Blake T. Biederman; Edward A. Steen

[57] ABSTRACT

The apparatus provides a unique and novel vessel and process that concentrate solids, produces paste and stores paste from mixtures of solids and liquids. The vessel or tank includes a vertical shaft mounted within the tank and a variable speed drive for rotating the shaft for circulating paste. The shaft includes a helical pump for lifting the paste and a rake arm extending outwardly from a lower portion of the shaft for moving the paste radially inward. A vertical flow director within the tank is connected to the shaft for maintaining paste flow and facilitating paste circulation at outer portions of the tank. A paste exit port through a lower portion of the tank is used for removing paste. The method forms a paste by first introducing a mixture of solids and liquids into a tank. A portion of the solids and liquids are lifted vertically to establish a circulation pattern within the tank. The circulation of the mixture of solids and liquids is maintained within outer portions of the tank with at least one flow director. The mixture of solids and liquids is then circulated at a controlled rate to form paste.

9 Claims, 3 Drawing Sheets

20
22
22
22
56
58
10
48
50
12
12
24
38
38
15
15
A
A
28
28
33
33
52
34B
34A
52
36
36
14
30
30
32
17
42
44
54
54
16
18
26

PASTE PRODUCTION AND STORAGE APPARATUS

TECHNICAL FIELD

The instant invention relates to effective liquid removal from solid/liquid mixtures. In particular, this invention relates to an apparatus and method for producing and maintaining a paste within a vessel.

BACKGROUND ART

In order to protect and maintain underground excavations, such as mines, from collapse, fillers of various formulations are introduced into the previously opened voids. Backfilling of mined-out cavities improves the structural integrity of the mine. Over the years, various materials have been utilized to backfill mines. Rocks, sand, tailings, grout, cement, elastomeric materials, etc., have all been used as backfill material with varying amounts of structural and economic success.

Backfilling of mines with crushed rock necessitates a costly and elaborate materials handling system. Therefore, the most common mining practice is to backfill with hydraulic fill. Hydraulic fill is a mixture of alluvial sand and/or mill tailings and a relatively small percentage of cement. The backfill procedure typically requires large quantities of water to transport the hydraulic fill through a pipeline system to various locations underground. Unfortunately, the large quantity of excess water required for effective pipeline flow reduces the hydration action of the cement in the hydraulic slurry. Furthermore, excess water containing significant quantities of cement must be drained from the solids and be pumped back to the surface. Hydraulic tailings fills are normally prepared by cyclone classification of mill tailings. Cycloning removes the finer sized particles to produce a sufficiently coarse product through which water can drain readily after placement in underground excavations.

Paste fill has recently been developed for use as an alternate backfill procedure. With paste fill, a properly sized material may be transported by gravity or pumped underground with minimum water content in the mix. Paste backfill procedures provide distinct advantages over hydraulic fills. First, a stronger backfill is produced with an equivalent mount of binder or cement. Second, the clean-up and water removal problems, normally associated with hydraulic fills are minimal or absent.

Whereas hydraulic fill is made up from a material having a sufficiently coarse size distribution, paste fills have a sufficiently fine particle component to minimize porosity and produce the "paste" characteristics. When mill tailings are used to produce a "paste," it is the "dewatering" process that becomes capital and operating cost intensive.

Paste slurries are normally prepared through a two-step dewatering process. First mineral waste slurries are partially dewatered using thickeners. Second, the higher density slurry is further dewatered with filters, such as vacuum filters, to produce a filter cake. Typically, filter cake products must be reconstituted with small quantities of water to produce a moveable paste product. Experience with the thickening/vacuum filtration has demonstrated the following solids concentration limits:

1) Thickening with flocculents typically achieves a maximum solids concentration of 40% by volume: largely dependent on the size and specific gravity of the particle.

2) Vacuum Filtration typically provides a maximum solids concentration of about 65% by volume.

The following Table illustrates some typical solids concentrating parameters for various materials:

TABLE 1

| Material | Specific Gravity Solids | Thickener weight (%) | Thickener volume (%) | Filter weight (%) | Filter volume (%) |
|---|---|---|---|---|---|
| Base metal Tails A | 2.9 | 58.7 | 43 | 84 | 64 |
| Base metal Tails Fine | 2.9 | 59 | 33 | 75 | 50 |
| Gold Tails | 2.6 | 45 | 24 | 65 | 41 |
| Laterite A | 4.0 | 62.7 | 29 | 72.5 | 39 |
| Laterite B | 3.4 | 51 | 23 | N/A | N/A |
| Base Metal Tails B | 2.8 | 66.9 | 42 | 74.2 | 50 |

N/A = Not Available

FIG. 1 depicts a relationship between the generally accepted process capabilities of: thickening, paste production, filtration, and volume percent solids of the material. Pastes are generally formed with a higher volume fraction of solids than "thickened" solutions and a lesser volume fraction of solids than filtered solutions. The ideal volume fraction for paste formation is material dependent.

Alcan Canadian Pat. No. 1,28(5,480 discloses a one step channel cutting mechanism for dewatering clay-like slurries such as "red mud" sources of alumina. However, these dewatering devices are not suitable for producing pastes from relatively heavy materials such as ground mineral slurries. Furthermore, since the device utilizes an active core, storage ability of the device has not been demonstrated.

It is an object of this invention to provide an apparatus and method capable of producing pastes in a single step operation that eliminates the conventional sequential processes of thickening, storage of thickener product, filtration and filter cake storage.

It is a further object of this invention to provide a process and device for producing and storing paste that will find application not only in mine backfill, as well as counter current decantation/washing circuits, roaster feed stock preparation systems, high solids content disposal of finely ground waste products and chemical slurries.

SUMMARY OF THE INVENTION

The invention provides a unique and novel vessel and process that concentrates solids, produces paste and stores paste from mixtures of solids and liquids. The vessel or tank includes a vertical shaft mounted within the tank and a means for rotating the shaft for circulating paste. The shaft includes a means for lifting the paste and a rake arm extending outwardly from a lower portion of the shaft for moving the paste radially inward. A vertical flow director within the tank is connected to the shaft for maintaining paste flow and facilitating paste circulation at outer portions of the tank. A paste exit port through a lower portion of the tank is used for removing paste. The method of the invention forms a paste by first introducing a mixture of solids and liquids into a tank. A portion of the solids and liquids are lifted vertically to establish a circulation pattern within the tank. The circulation of the mixture of solids and liquids is maintained within outer portions of the tank with at least one flow director. The mixture of solids and liquids is then circulated at a controlled rate to form paste.

PREFERRED MODE FOR CARRYING OUT THE INVENTION

It has been discovered that a tank containing a helical lifting pump, a rake arm, and side flow directors may be used to produce pastes in a single step operation. The rpm of the lifting pump, rake arm and flow directors may be readily adjusted to form pastes from a wide variety of materials. Furthermore, the device may be continuously operated with its exit port closed to indefinitely store material without consolidation problems.

Figure 2:
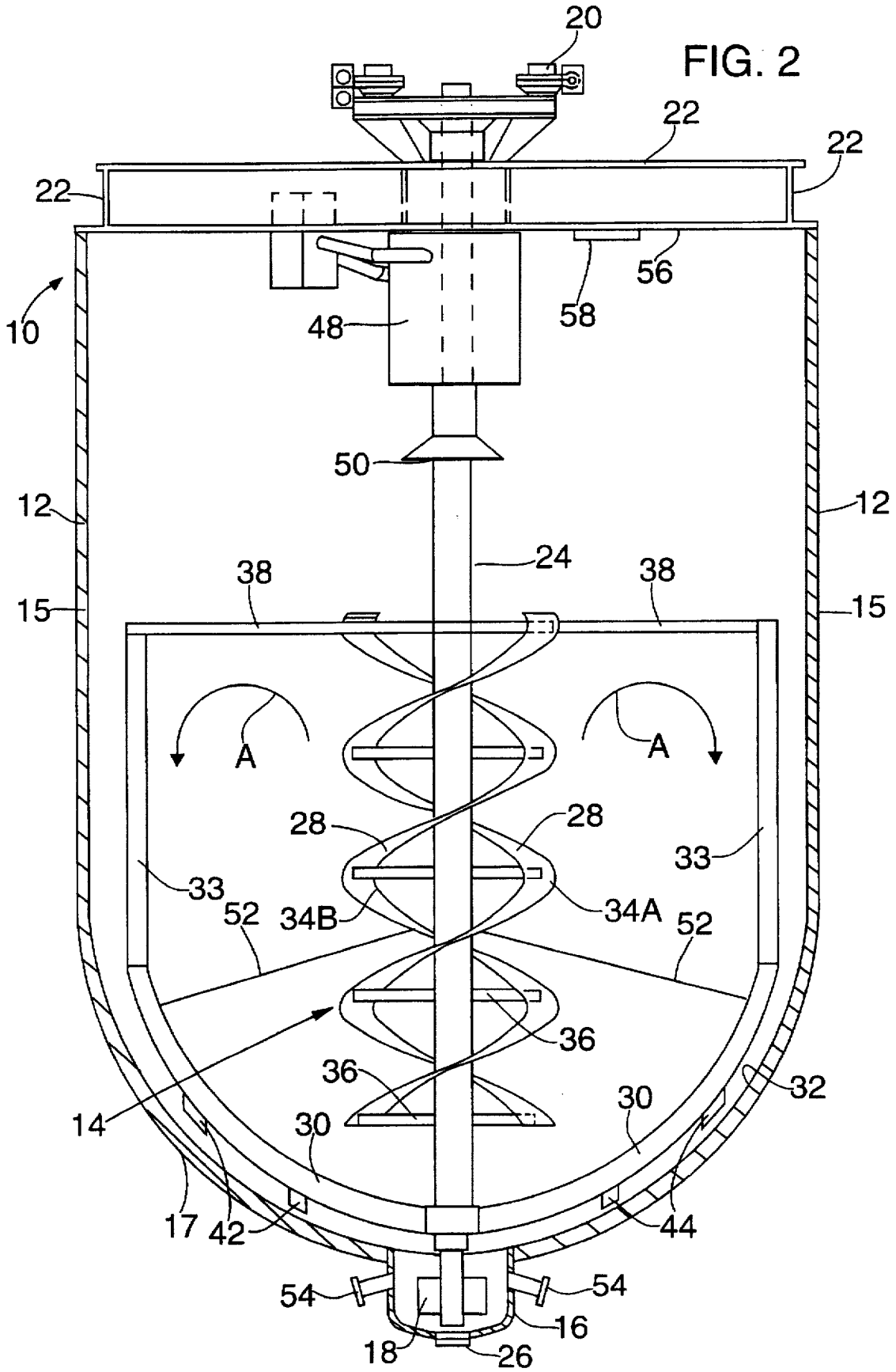
FIG. 2 is a cross-sectional elevation of an embodiment of the invention.
Figure 3:
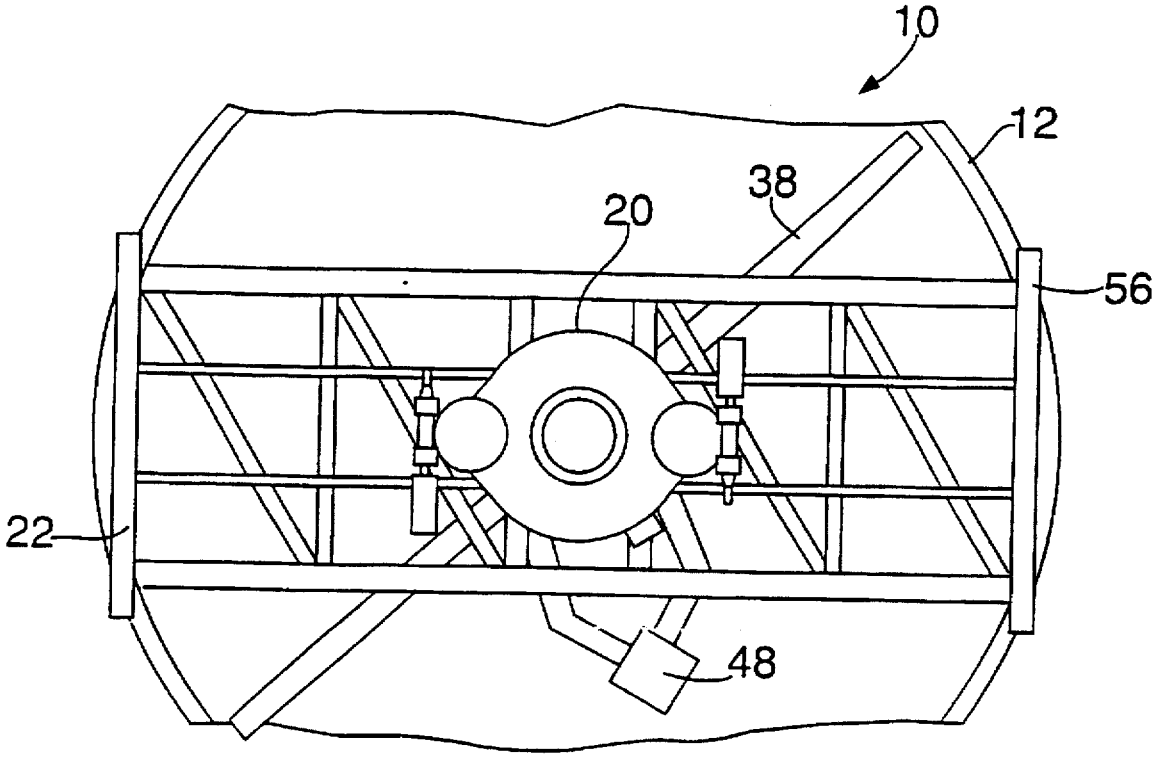
FIG. 3 is a plan view of FIG. 2.

FIG. 2 depicts a paste production and storage apparatus 10. The apparatus 10 includes a vessel or tank 12 and a paste circulator 14. The tank 12 has cylindrical side walls 15 and most advantageously a hemispherical bottom 17. A pod 16, enclosing a pair of rotating blades 18, is disposed at the bottom of the tank 12. A suitable variable speed drive 20 is advantageously affixed to the top of the tank 12 for rotating the paste circulator 14. Advantageously, a motor and reducer with a sufficient torque capability to operate the device in the speed range of about 0.1 to 1.0 rpm is used. A cover 22 such as a grating, placed over the tank 12 with a series of beams 56, advantageously supports the drive 20 and the paste circulator 14 (FIG. 3 more clearly illustrates the cover 22 of the apparatus 10).

A vertical shaft 24 extends from the drive 20 through the tank 12 and is supported by a bearing unit 26 in the pod 16. The paste circulator 14 is attached to the shaft 24 and is rotated clockwise within the tank 12. Advantageously, the paste circulator 14 (helical pump 28, rake arm 30 and flow director 33) is symmetrical with respect to the shaft 24 to minimize stresses. A cylindrical pod advantageously collects the paste in a form suitable for entry into an underflow piping system without ratholing or bridging. Most advantageously, the exit blades 18 are used to pump paste from the pod 16 and/or maintain the paste in the pod 16.

The paste circulator 14 advantageously consists of a double helical pump 28, a rake arm 30 and at least one vertical flow director 33. Optionally, a single helical pump design or alternate lifting means such as a series of angled blades or paddles may be used. The double helical pump 28 is mounted approximately midway down the shaft 24 and extends towards the pod 16. As double helical pump 28 rotates clockwise, it vertically lifts a portion of the paste to establish circulation pattern A. The rake arm 30 extends outwardly from the bottom portion of the shaft 24 and advantageously is in close proximity with the inner surface 32 of the tank 12. Most advantageously, the rake arm 30 is inwardly curved to match the contour of the hemispherical bottom 17.

The double helical pump 28, most advantageously comprises two sets of intertwining helical flights 34A and 34B. The helical flights 34A and 34B are most advantageously affixed to the shaft 24 by a plurality of supports 36 bridging the shaft 24 and the flights 34A and 34B.

The flow directors 33 slice through material adjacent to the cylindrical wall 15. The flow directors 33 are advantageously connected to the rake arms 30 and a support beam 38. Alternately, flow directors may be attached independent of the rake arm 30 and the support beam 38. The flow director bars are configured to prevent peripheral material from bridging by changing the material flow velocity at the tank wall, and thus facilitate the downward circulation path of the material. During operation, the motion of the material and the local force of one particle bearing upon another causes the particles to move closer together and form a paste. The movement of the rake arm 30 and the flow director 33 combine to prevent undesirable consolidation of the material in the tank. Experimental testing has proven that at least one flow director 33 is essential to effective operation of the device. The flow directors 33 slice through the paste to ensure uniform distribution of the paste. Advantageously, the apparatus contains at least two rake arms 30 and at least two flow directors 33 symmetrically mounted about the shaft 24 in a mirror image to the shaft 24. At least two rake arms 30 and flow directors 33 are required to balance the load on the shaft 24. Most advantageously, the paste circulator 14 contains two rake arms 30 and two flow directors 33.

The rake arm 30 most advantageously extends outwardly from the shaft 24, as a single continuous member, in a horizontally and upwardly "U" shaped fashion following the hemispherical bottom 17. The staggered blades 42 and 44, most advantageously positioned as segments of a logarithmic spiral curve, serve to slide the material inward toward the pod 16 and the double helical pump 28. The blades 42 and 44 are advantageously oriented in an asymmetrical sequential fashion. The blades 42 and 44 are advantageously positioned at an optimum angle to the direction of rotation and having length and width proportions that together with the rotational speed will transport paste radially inward. Optimum portions of the blades 42 and 44 are functions of the materials utilized and the size of the tank 12. The double helix 28 will tend to pump the material vertically upward thereby establishing a circulation pattern within the tank 12. Most advantageously, the staggered blades 42 and 44 are sized to move particles toward the center at a rate equal to the vertical lift of the double helix 28.

The introduction of the dilute solids/liquid mixture into the tank is carried out in the same manner as in thickening, except that it is advantageous to employ a special flocculating feedwell 48. The feedwell 48 provides a single source of feed that channels the material into the center of the tank 12. For mine tailings, it is preferred to add suitable flocculent directly with the tailings. The flocculent facilitates the settling of solids for more effective liquid/solid separation. A deflector cone 50, mounted on the shaft 24, most advantageously forces the material to spread out within the tank 12 as it falls. As material enters through the feedwell 48, overflow liquid is removed through overflow a launder 58. Most advantageously, material is introduced in a top portion of the tank 12 to allow setting prior to contact with the paste.

Most advantageously, a pair of braces 52, bridging the shaft 24 and the rake arm 30, are affixed via a pair of turnbuckles (not illustrated) for support. In addition, the tank 12 most advantageously includes a door (not illustrated) to allow periodic maintenance. However, since components travel at an extremely slow rate, little, if any, wear has been observed.

A pair of discharge outlets 54 advantageously permit the paste or slurry to exit the apparatus 10 for delivery to a cement plant mixer or other suitable device. The exit blades 18 advantageously maintain fluidity of the material to facilitate flow through the outlets 54. The apparatus of the invention may be operated on a batch or a continuous basis. Most advantageously, apparatus 10 is operated on a continuous basis. With respect to mining backfill operations, after delivery to the cement mixer, the augmented paste/cement mixture is advantageously routed to the underground workplace through a borehole and piping for subsequent utilization.

Figure 4:
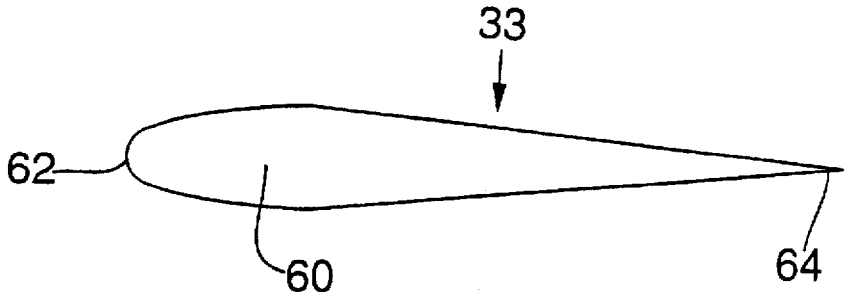
FIG. 4 is a cross-sectional view of a flow director.

Referring to FIG. 4, the rakes and flow directors are most advantageously constructed with a hydrodynamically designed shape. The hydrodynamically designed shape of a stabilizer bar 60 is used to reduce the torque required to rotate the paste circulator. Most advantageously, a blunt leading edge 62 and a trailing knife edge 64 are used in combination to reduce resistance to movement for the rake and flow directors. Alternatively, for relatively small paste tanks, plates or even cylindrical piping may be used to construct rakes and/or flow directors.

EXAMPLE

Figure 1:
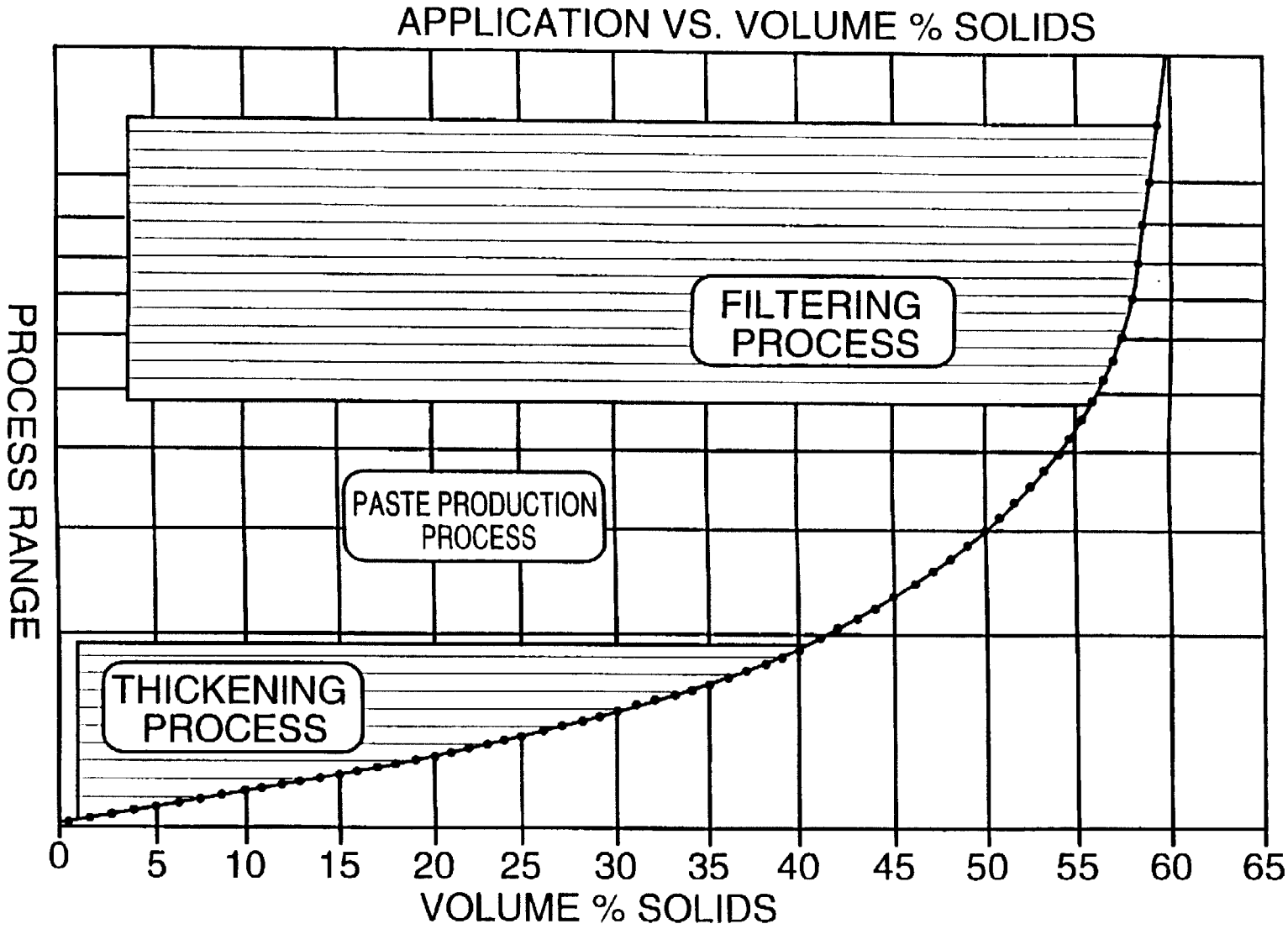
FIG. 1 depicts a relationship between the usual process capabilities of thickening, paste production, filtration, and volume percent solids of the material.

Following bench scale testing in a 12" (30.5 cm) diameter paste production storage mechanism, a 72" (182.9 cm) pilot scale unit containing the paste circulator design of FIG. 1 was constructed and tested. The materials tested consisted of base metal tailings, base metal tailings (fine fraction) and gold tailings. The essential variable in these tests was percentage of fines in the mixture. The amount of fines in the materials ranged from base metal tails having 25 weight percent passing a 20 micron screen to gold tails having 60–70 weight passing a 20 micron screen. A comparison of optimum paste-generating conditions is provided in Table 2 below:

TABLE 2

| MATERIAL | −20μ SIZING (Wt %) | TORQUE (ft · lbf) | TORQUE (N · m) | SPEED (rpm) | FEED (Wt %) | DISCHARGE (Wt %) | DISCHARGE (Vol. %) |
|---|---|---|---|---|---|---|---|
| (a) Base Metal Tails | 20–30 | 1600 | 2174 | 0.93 | 15 | 80 | 58 |
| (b) Base Metal Fine Tails | 40–50 | 415 | 564 | 0.93 | 20 | 76 | 52 |
| (c) Gold Tails | 60–70 | 56 | 76 | 0.40 | 20 | 56 | 32 |
| *(d) Base Metal Tails | 20–30 | 5840 | 7935 | 0.82 | 13 | 84 | 64 |

*No flow directors, all other tests utilized flow directors.

The paste production storage mechanism utilizing flow directors was readily adjusted to produce paste in a single step operation for all materials and size fractions tested. As is readily apparent from test (d), flow directors are essential to consistently producing paste at a commercially practical torque level.

The apparatus and method of the invention are advantageously operated in accordance with the following principles:

1. Fundamentally, a pattern of circulation is achieved within the tank to deliberately upset the gravitational force that causes sedimentation. Stacking of naturally sedimented particles is disrupted, resulting in a more uniform stacking pattern (paste formation). Gravity works to squeeze water from the pore spaces while the disturbance from the paste circulator (rake/helical pump/flow directors) packs finer particles into the spaces formed by larger particles. The apparatus of the invention transports (slides) material from the "underneath" or bottom zone of the tank radially toward the center, then transports (lifts) this material vertically upwards to establish a circulation pattern (see directional arrows A of FIG. 2).

2. Transport rates of the material radially inward should not exceed the vertical transport rates. When the radial transport rate is much greater than the vertical rate, the radially transported material pushes against slow moving material in the central zone compacting the material to form higher solids concentrations. Overly compacted materials lose their paste characteristics and will not flow.

3. The rake blade sweep angle and the helical pump lead angle are advantageously selected to minimize shear stresses with the paste slurry.

4. Structural shapes are deliberately selected to reduce boundary layer pressure gradient effects, especially rake arms, blades and helical pumps. For example, changing the shape of the arm cross section from cylindrical to blunt knife with tailing relief effectively lowered torque significantly for a large system (greater than a 10 m diameter).

5. The motion of the paste must be achieved by lifting and/or sliding not by pushing or extruding. Both of the latter promote dewatering and the formation of an interlocked and immobile structure of particles (bridging).

6. A "turbulent" zone is generated through the use of vertical flow directors adjacent to the storage vessel wall to discourage the natural buildup of highly compacted solids that can become unstable and sluff-off during periods of paste withdrawal.

7. It has further been discovered that relationships exist between the torque and speed requirements of the mechanism and the particle size distribution to achieve production of a suitable paste. This allows a single step paste production/storage unit to be configured for various mineral or chemical slurries. Without this rpm control, paste will not be produced. Optimum rpm is material specific. For example, too low of an rpm will lead to compacted solids which will not flow out of the tank. Similarly, too high of an rpm will operate the device as a mixer, removing insufficient water to form a paste.

The apparatus and method of the invention are particularly effective at forming backfill paste from mine tailings. Additional applications that can benefit from the application of the invention include counter current decantation/washing circuits, roaster feedstock preparation systems, high solids content disposal of finely ground waste products, and concentrating of chemical slurries.

The invention facilitates the withdrawal of solids in the tank without ratholing (the short circuiting of decant water to the discharge port) as is the typical industrial experience with storage vessels containing high density slurries. The invention further provides an apparatus and device for producing and storing pastes in a single step. Forming pastes in a single step reduces equipment requirements, speeds operation and eliminates the costly maintenance associated with filtration. The invention further allows rpm control to optimize liquid content of pastes. Pastes having a consistency resembling commercially available tooth paste are readily formed with the apparatus of the invention. In addition, since the paste circulator travels at a relatively slow rate, wear of the rake arms and flow director is not expected to be a problem. Finally, the device may be used to store paste indefinitely without consolidation problems.

While in accordance with the provisions of the statute, there is illustrated and described herein specific embodiments of the invention. Those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. An apparatus for forming pastes from mixtures of solids and liquids, the apparatus comprising a tank, said tank having a side wall, a vertical shaft disposed in said tank, means for rotating the shaft for circulating a paste, the shaft including a means for lifting the paste and a rake arm extending outwardly from a lower portion of said shaft, said rake arm having blades for pushing paste radially inward, a flow director connected to said shaft for rotating adjacent to said side wall of said tank and said flow director being hydrodynamically shaped for decreasing resistance and having a blunt leading edge and a trailing knife edge for slicing through said paste to facilitate circulation of the paste adjacent outer portions of said tank and a paste exit port through a lower portion of said tank for removing paste.

2. The apparatus according to claim 1 wherein the bottom of said tank is hemispherical.

3. The apparatus according to claim 2 wherein said rake arm is disposed above said hemispherical bottom of said tank and said rake arm is inwardly curved to a contour matching said hemispherical bottom.

4. The apparatus according to claim 1 wherein said blades are sequentially mounted on said rake arm for sliding the materials toward said shaft.

5. The apparatus according to claim 1 wherein said paste exit port includes a pod having a discharge outlet.

6. The apparatus according to claim 1 wherein a deflector cone is mounted to said shaft.

7. The apparatus according to claim 1 including a means for introducing material in a top portion of said tank.

8. The apparatus of claim 1 wherein said means for lifting material is a helical pump.

9. The apparatus according to claim 1 wherein two rake arms and two flow directors are attached to said shaft symmetrically.

* * * * *